US011064287B2

(12) United States Patent
Lin

(10) Patent No.: US 11,064,287 B2
(45) Date of Patent: Jul. 13, 2021

(54) SPEAKER

(71) Applicant: Merry Electronics(Shenzhen) Co., Ltd., ShenZhen (CN)

(72) Inventor: Chia-Chung Lin, Taichung (TW)

(73) Assignee: Merry Electronics(Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/741,761

(22) Filed: Jan. 14, 2020

(65) Prior Publication Data

US 2021/0099790 A1 Apr. 1, 2021

(30) Foreign Application Priority Data

Sep. 26, 2019 (TW) ..... 108134850

(51) Int. Cl.

| | |
|---|---|
| ***H04R 1/28*** | (2006.01) |
| ***H04R 1/10*** | (2006.01) |
| ***H04R 7/12*** | (2006.01) |
| ***H04R 7/18*** | (2006.01) |
| ***H04R 9/02*** | (2006.01) |
| ***H04R 9/06*** | (2006.01) |
| ***H04R 1/02*** | (2006.01) |

(52) U.S. Cl.

CPC ..... *H04R 1/2803* (2013.01); *H04R 1/025* (2013.01); *H04R 1/1075* (2013.01); *H04R 1/2819* (2013.01); *H04R 1/2826* (2013.01); *H04R 7/12* (2013.01); *H04R 7/18* (2013.01); *H04R 9/025* (2013.01); *H04R 9/06* (2013.01); *H04R 2400/11* (2013.01); *H04R 2460/11* (2013.01)

(58) Field of Classification Search

CPC .... H04R 1/025; H04R 1/2807; H04R 1/2811; H04R 1/2815; H04R 1/2819; H04R 1/2842; H04R 1/2849; H04R 1/2857; H04R 9/06; H04M 1/035; H04M 1/03

USPC ..... 381/338, 370, 372, 380, 349, 350

See application file for complete search history.

(56) References Cited

U.S. PATENT DOCUMENTS

| | | | | |
|---|---|---|---|---|
| 4,239,945 A * | 12/1980 | Atoji | H04R 1/2819 | 381/349 |
| 4,742,887 A * | 5/1988 | Yamagishi | H04R 1/22 | 181/129 |
| 6,389,145 B2 * | 5/2002 | Baumhauer, Jr. | H04R 1/2842 | 379/432 |
| 8,331,599 B2 * | 12/2012 | Yun | H04M 1/035 | 381/345 |
| 2020/0112783 A1 * | 4/2020 | Wakeland | H04R 9/025 | |

* cited by examiner

*Primary Examiner* — Huyen D Le
(74) *Attorney, Agent, or Firm* — JCIPRNET

(57) ABSTRACT

A speaker includes a frame, a first tuning portion, a vibration system and a magnetic circuit system. The frame has a lateral wall, a bottom wall, an accommodation space defined by the lateral wall and the bottom wall and an opening end located at a top end of the accommodation space. The first tuning portion is formed on the lateral wall of the frame. The vibration system is disposed in the accommodation space of the frame and has a vibration film vibrating along an axial direction of the frame. A rear chamber is defined by the vibration film and the bottom wall of the frame. The magnetic circuit system is disposed in the accommodation space of the frame. When the vibration film vibrates, an airflow generated in the rear chamber flows along the first tuning portion on the lateral wall and exits, so as to form a first tuning path.

13 Claims, 9 Drawing Sheets

SPEAKER

CROSS-REFERENCE TO RELATED APPLICATION

This application claims the priority benefit of Taiwan application serial no. 108134850, filed on Sep. 26, 2019. The entirety of the above-mentioned patent application is hereby incorporated by reference herein and made a part of this specification.

BACKGROUND

Field of the Invention

The invention relates to a speaker and more particularly, to a speaker capable of being disposed closely to a head phone inner casing and achieving preferable sound performance.

Description of Related Art

Generally, a rear chamber of a speaker is formed between a vibration film and a bottom wall of a frame, a tuning hole of the speaker is disposed on the bottom wall of the frame, and a tuning paper may be attached to the tuning hole for tone tuning. However, as a head phone inner casing is located closely to the tuning hole of the speaker, resonance reflection tends to occur in the presence of an insufficient distance, such that the presentation of a sound curve may be influenced. Moreover, since the head phone inner casing in most cases has an irregular shape, it may result in the occurrence of resonance due to non-smooth or unbalanced outward ventilation. Especially, current head phones are designed toward being light and thin, which makes the issue related to the insufficient distance between the tuning hole of the speaker and the head phone inner casing even worse.

SUMMARY

The invention provides a speaker which can disposed closely to a head phone inner casing and achieve preferable sound performance.

A speaker of the invention includes a frame, a first tuning portion, a vibration system and a magnetic circuit system. The frame has a lateral wall, a bottom wall, an accommodation space defined by the lateral wall and the bottom wall and an opening end located at a top end of the accommodation space. The first tuning portion is formed on the lateral wall of the frame. The vibration system is disposed in the accommodation space of the frame. The vibration system includes a vibration film vibrating along an axial direction of the frame, and a rear chamber is defined by the vibration film and the bottom wall of the frame. The magnetic circuit system is disposed in the accommodation space of the frame. When the vibration film vibrates, an airflow generated in the rear chamber flows along the first tuning portion formed on the lateral wall and is guided out of the first tuning portion, so as to form a first tuning path.

In an embodiment of the invention, the bottom wall is recessed in a direction toward the vibration film, the frame includes an inner wall connected to a lower surface of the bottom wall, and a second tuning portion is formed between the lower surface of the bottom wall of the frame and the inner wall.

In an embodiment of the invention, the second tuning portion presents a C shape in a viewing angle along the axial direction and has a notch, the frame includes a platform connected to the inner wall and the lateral wall and located at the notch, and the speaker includes a circuit board disposed on the platform.

In an embodiment of the invention, the bottom wall has a first through hole to allow the rear chamber and the second tuning portion to communicate with each other.

In an embodiment of the invention, a radial sectional shape of the rear chamber is gradually expanded in a direction from the inside toward the lateral wall.

In an embodiment of the invention, a radial sectional shape of an upper surface of the bottom wall at least partially corresponds to a radial sectional shape of the vibration film.

In an embodiment of the invention, the speaker further includes a plate attached to the lower surface of the bottom wall of the frame.

In an embodiment of the invention, the second tuning portion presents a C shape in a viewing angle along the axial direction, the bottom wall has a first through hole adjacent to an end of the C shape, the plate has a second through hole communicating with the second tuning portion, the second through hole is adjacent to the other end of the C shape, and a second tuning path is formed by the first through hole, the second tuning portion and the second through hole.

In an embodiment of the invention, the plate is a Mylar film or a head phone inner casing.

In an embodiment of the invention, the speaker further includes a tuning paper disposed at the lateral wall to shield the first tuning portion.

In an embodiment of the invention, the first tuning portion is formed by at least one through hole surrounding the lateral wall.

In an embodiment of the invention, the first tuning path is not parallel to the vibration direction of the vibration film.

In an embodiment of the invention, the vibration film vibrates along the axial direction of the frame to define a first axial direction, the airflow generated in the rear chamber flows along a second axial direction and is guided out of the first tuning portion formed on the lateral wall of the frame, and the first axial direction and the second axial direction have an intersection angle therebetween.

In an embodiment of the invention, the first axial direction and the second axial direction have a vertical angle therebetween.

Based on the above, in the invention, the first tuning portion is formed on the lateral wall of the frame, such that when the vibration film vibrates, the airflow generated in the rear chamber flows along the first tuning portion formed on the lateral wall and is guided out of the first tuning portion. In other words, the airflow is exhausted from the side of the speaker, rather than from the bottom of the speaker. Thus, the speaker of the invention can be disposed closely to the head phone inner casing, and the head phone inner casing can be close to the bottom wall of the speaker of the invention in a short distance, without causing resonance reflection or influencing a sound curve of the speaker, so as to achieve preferable sound performance.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
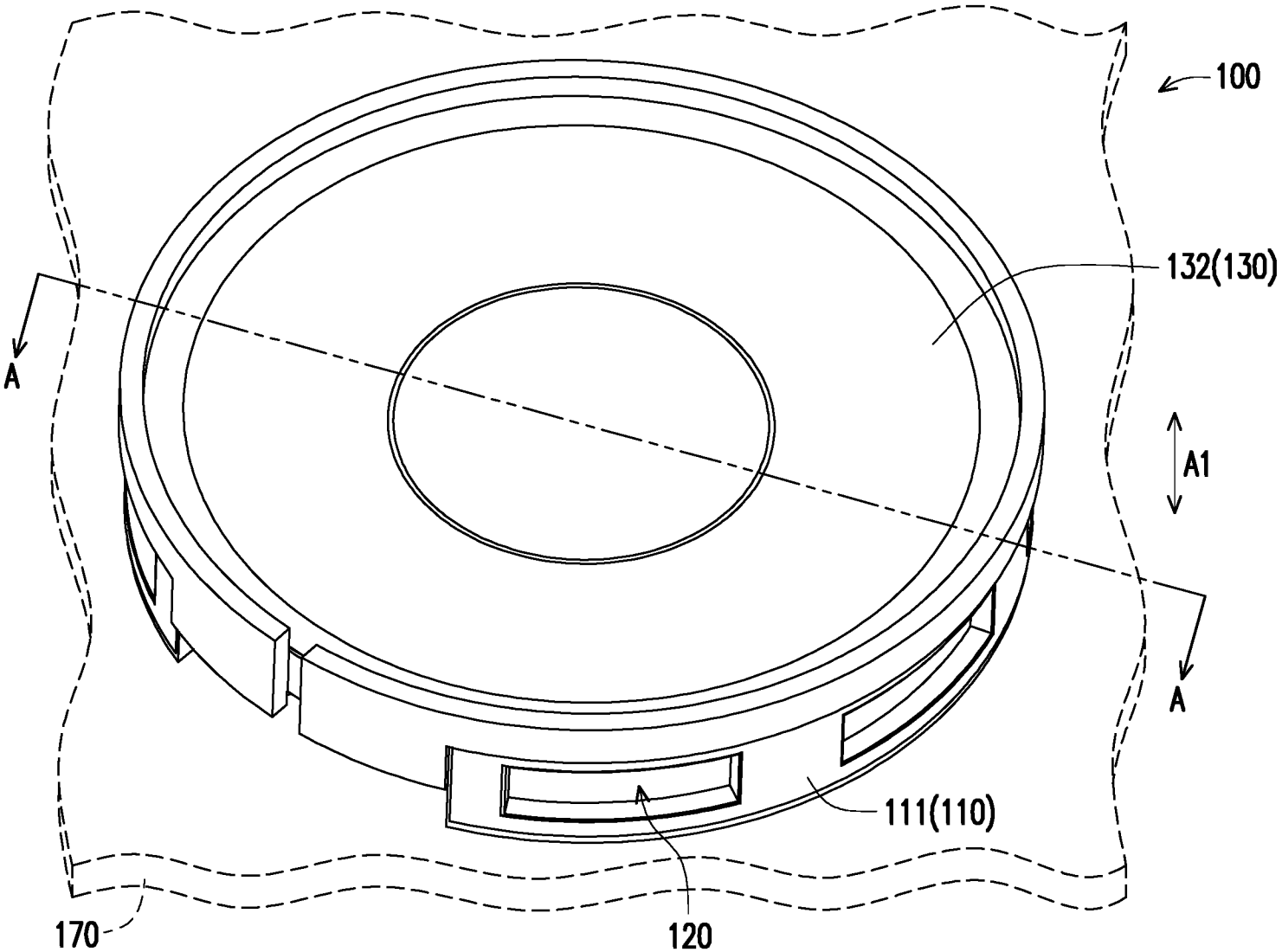
FIG. 1 is a schematic top three-dimensional (3D) diagram illustrating a speaker according to an embodiment of the invention.
Figure 2:
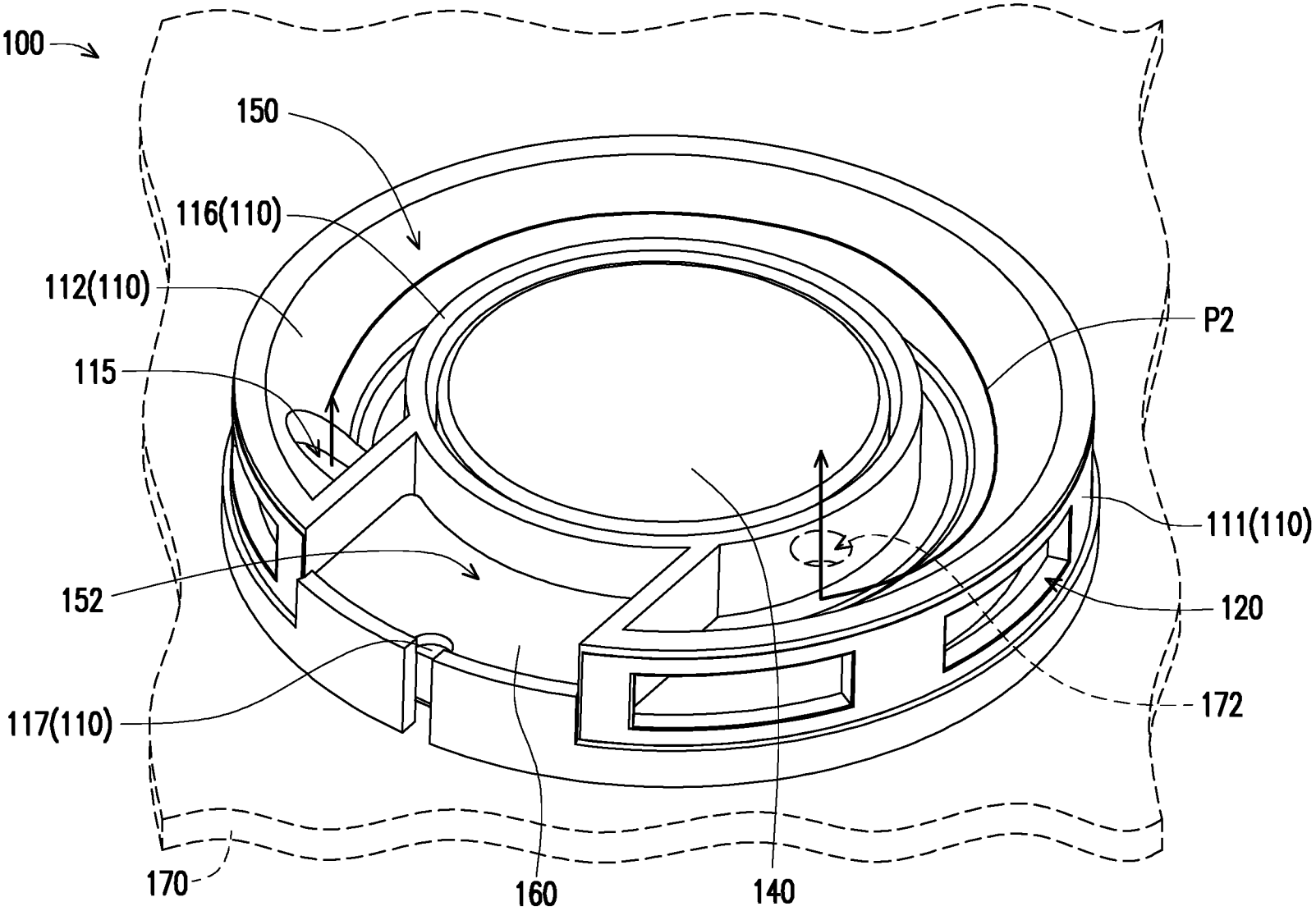
FIG. 2 is a schematic bottom 3D diagram illustrating the speaker depicted in FIG. 1.

FIG. 1 is a schematic top three-dimensional (3D) diagram illustrating a speaker according to an embodiment of the invention. FIG. 2 is a schematic bottom 3D diagram illustrating the speaker depicted in FIG. 1. It should be mentioned that in order to clearly illustrate a first tuning portion 120, a tuning paper 180 is hidden from FIG. 1 and FIG. 2, and to clearly show a bottom surface of a speaker 100, a plate that may be selectively disposed on a lower surface 114 of a bottom wall 112 of the frame 110 is specifically shown by dashed lines.

Referring to FIG. 1 to FIG. 2, the speaker 100 of the present embodiment is, for example, one that is applied to a head phone, but the field that the speaker 100 is applied to is not limited thereto. The speaker 100 of the present embodiment is designed with a special structure that a head phone inner casing is disposed closely to or directly on the bottom surface of the speaker 100 without causing resonance reflection, thereby achieving preferable sound performance, which will be described below.

Figure 3:
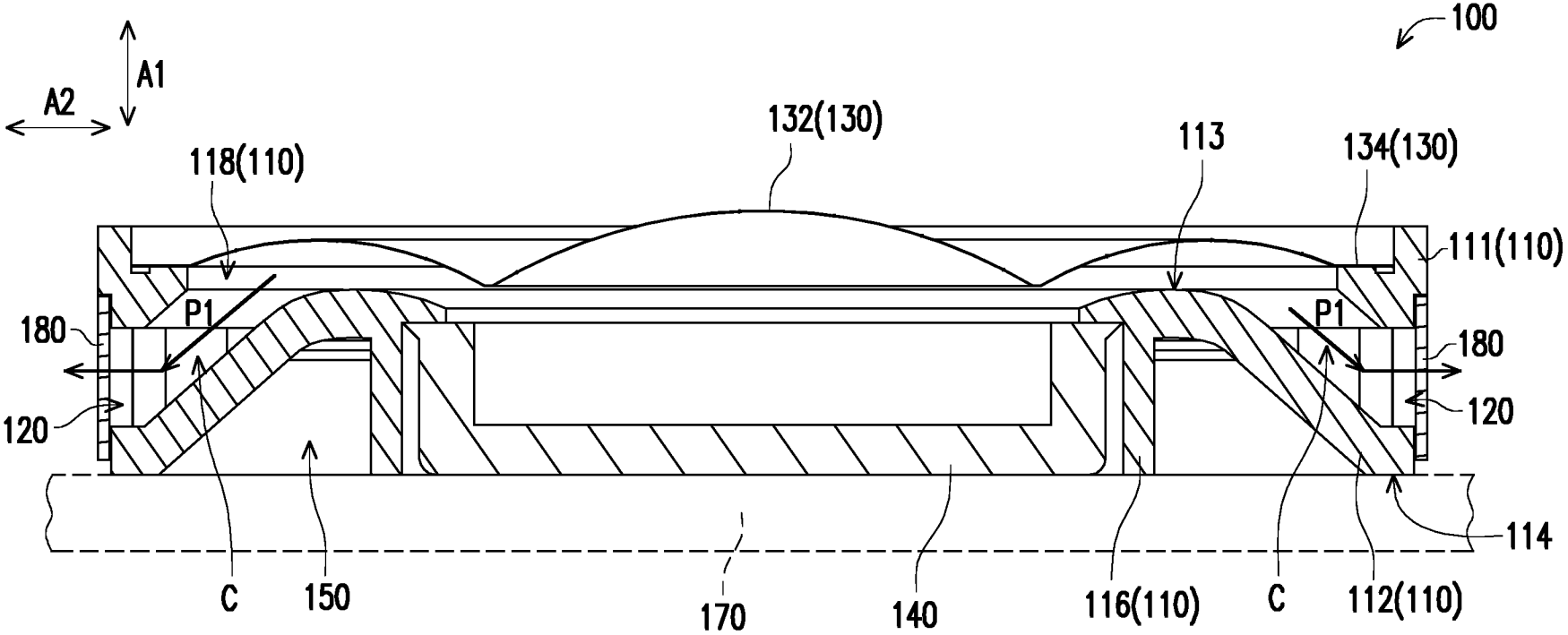
FIG. 3 is a schematic cross-sectional diagram illustrating the speaker depicted in FIG. 1 along a line A-A.
Figure 4:
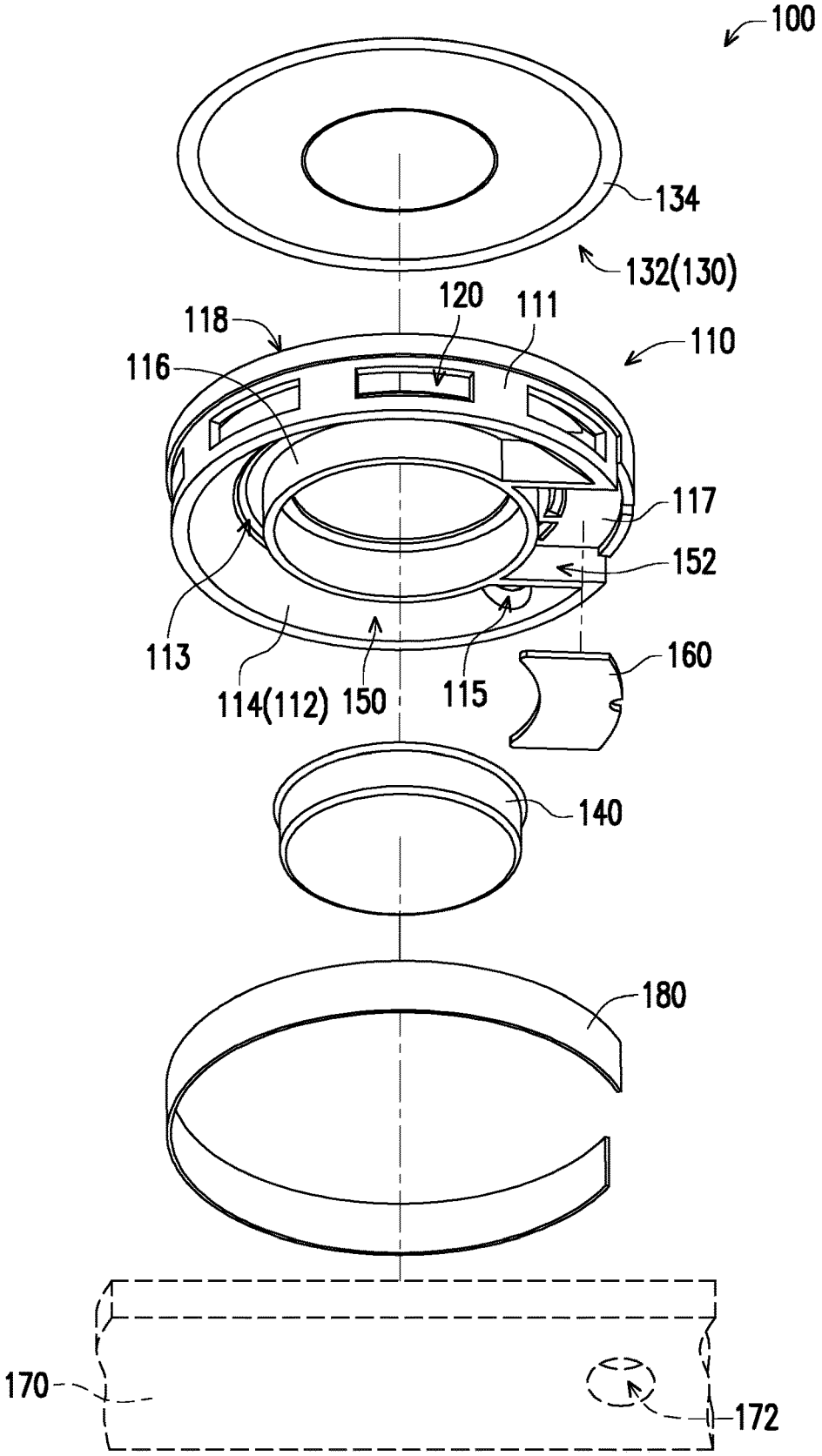
FIG. 4 is a schematic exploded diagram illustrating the speaker depicted in FIG. 1.
Figure 5:
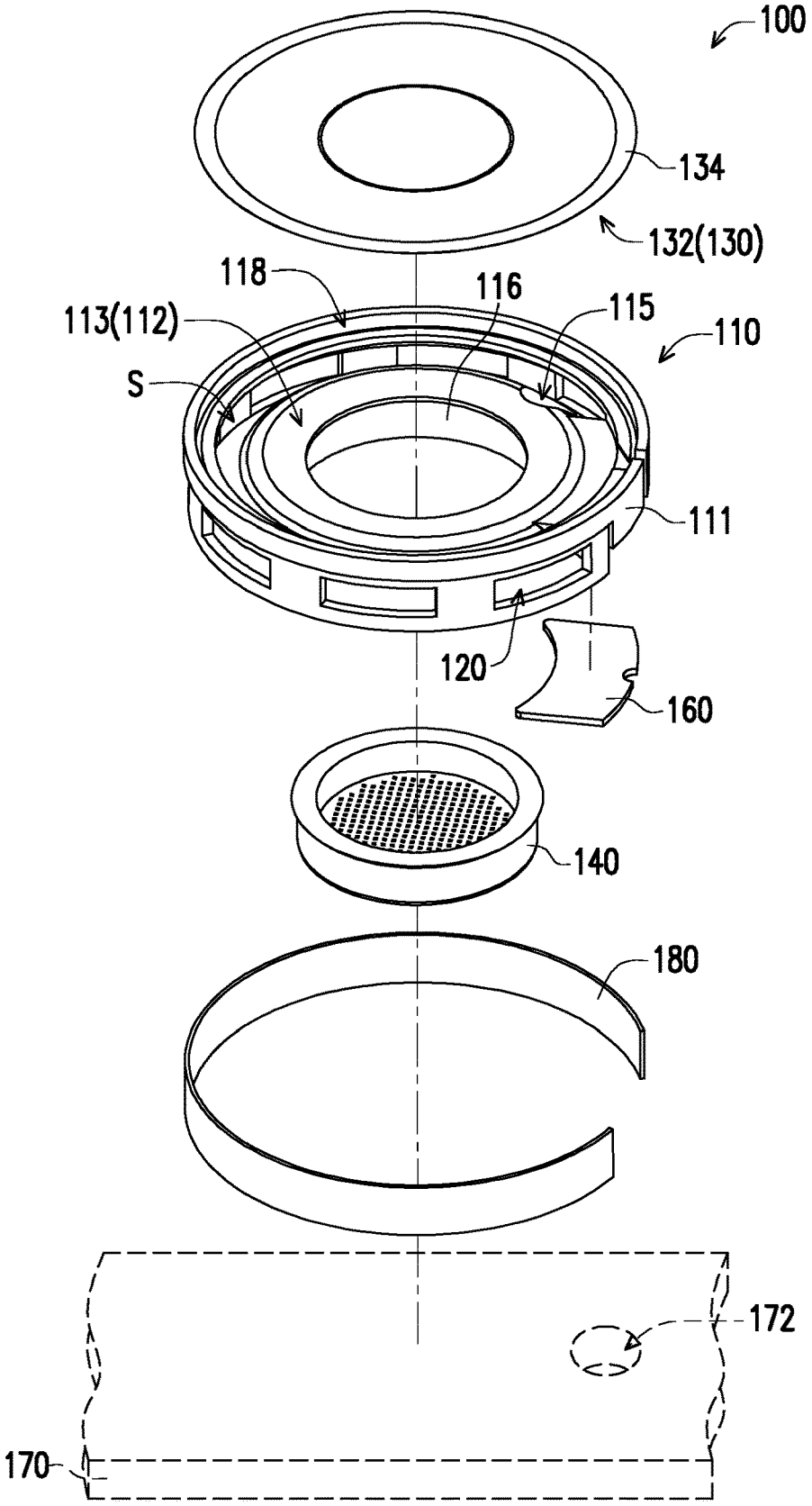
FIG. 5 is a schematic diagram of FIG. 4 in another viewing angle.

FIG. 3 is a schematic cross-sectional diagram illustrating the speaker depicted in FIG. 1 along a line A-A. FIG. 4 is a schematic exploded diagram illustrating the speaker depicted in FIG. 1. FIG. 5 is a schematic diagram of FIG. 4 in another viewing angle. Referring to FIG. 3 to FIG. 5, the speaker 100 of the present embodiment includes a frame 110, a first tuning portion 120, a vibration system 130 and a magnetic circuit system 140.

Figure 6:
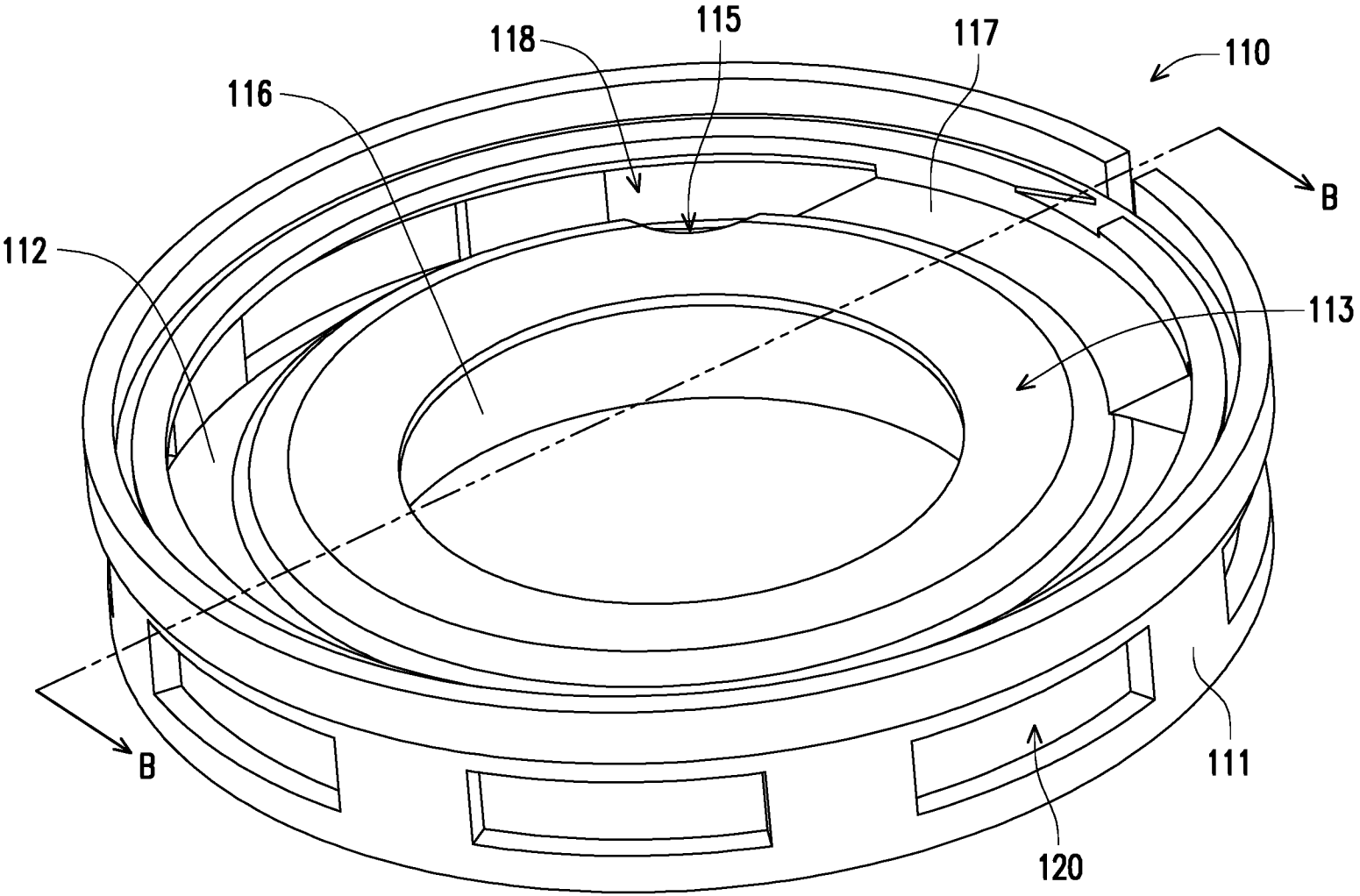
FIG. 6 is a schematic top 3D diagram illustrating the frame of the speaker depicted in FIG. 1.
Figure 7:
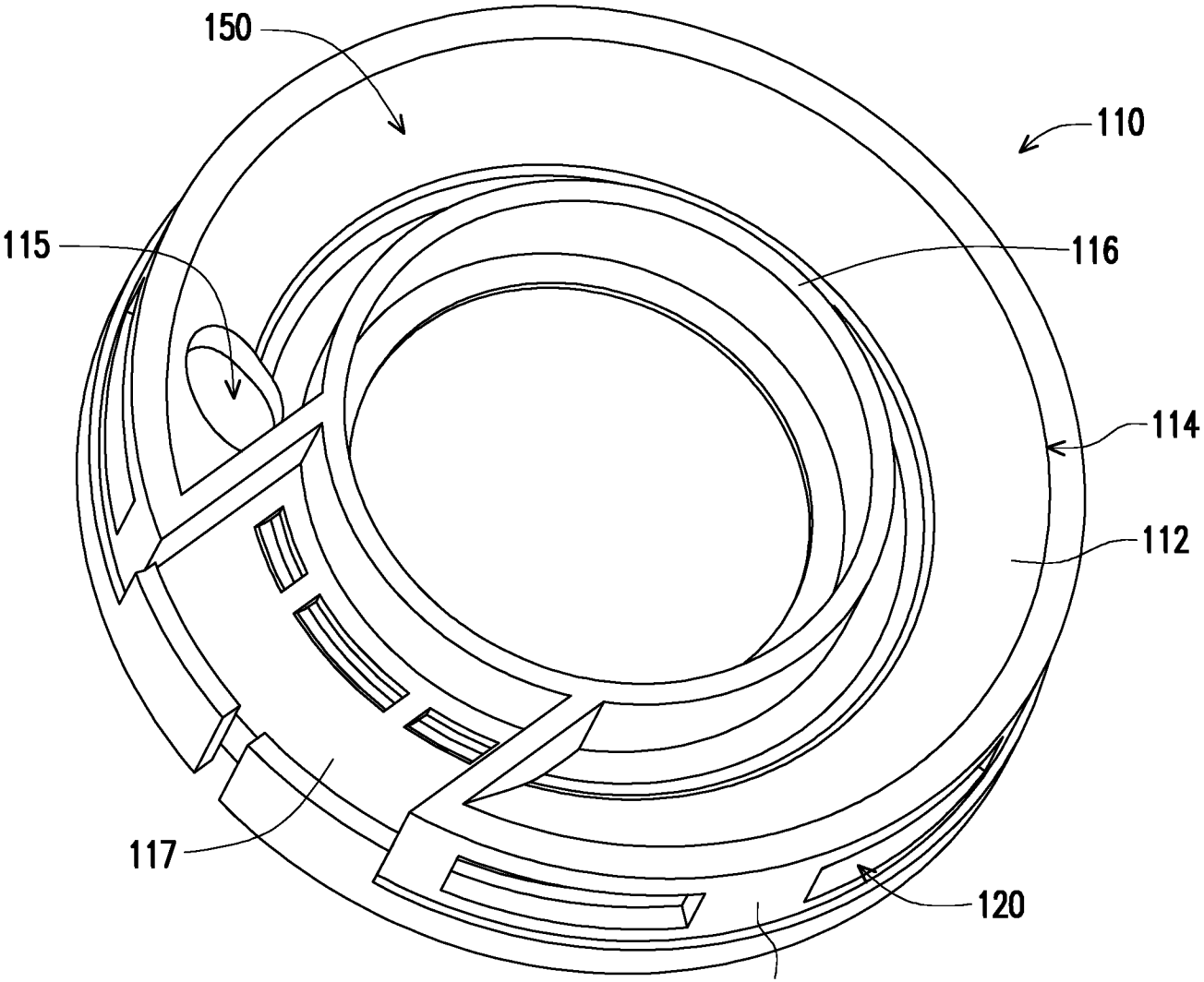
FIG. 7 is a schematic bottom 3D diagram illustrating the frame of the speaker depicted in FIG. 1.
Figure 8:
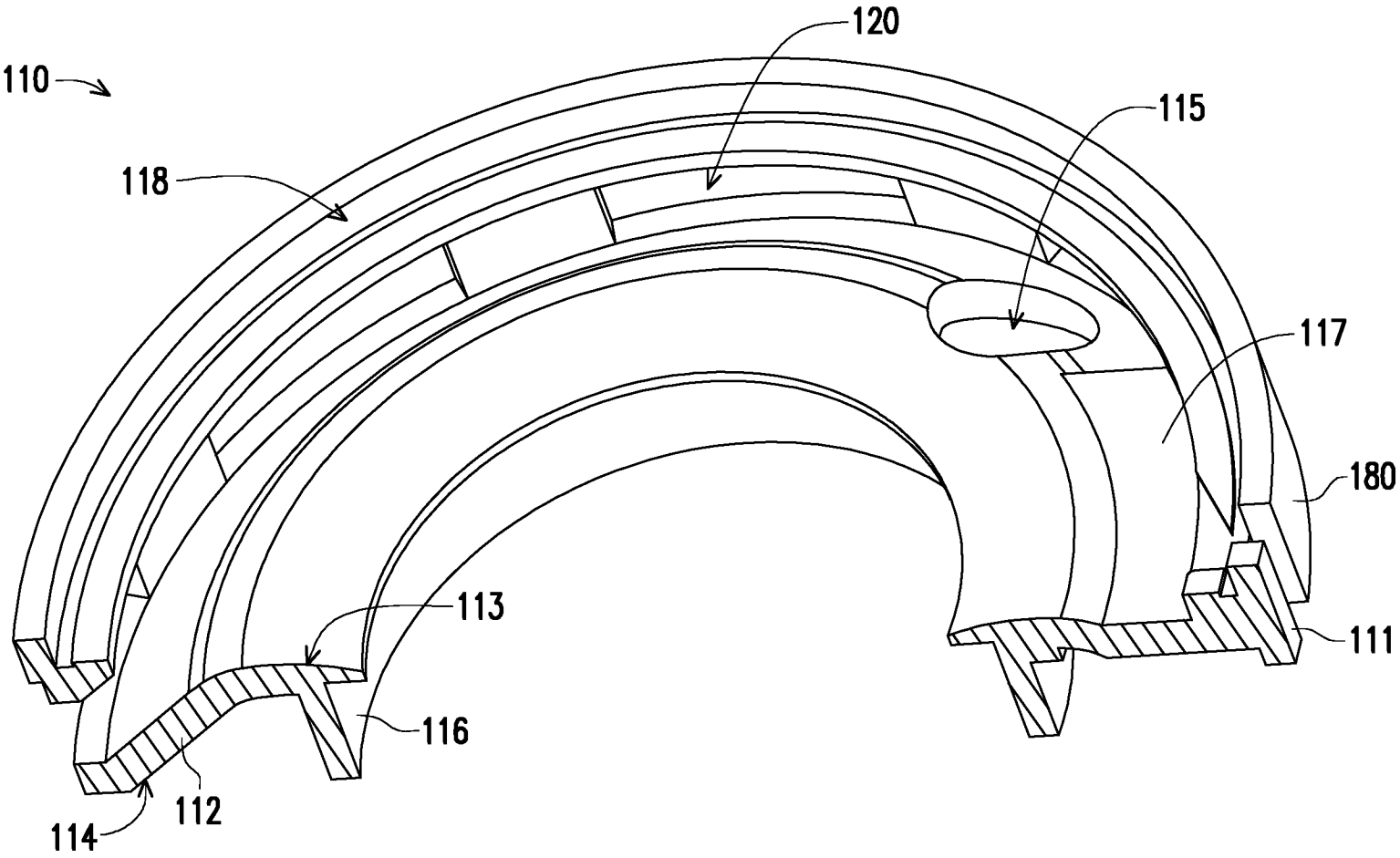
FIG. 8 is a schematic 3D diagram separated from FIG. 6 along a line B-B.
Figure 9:
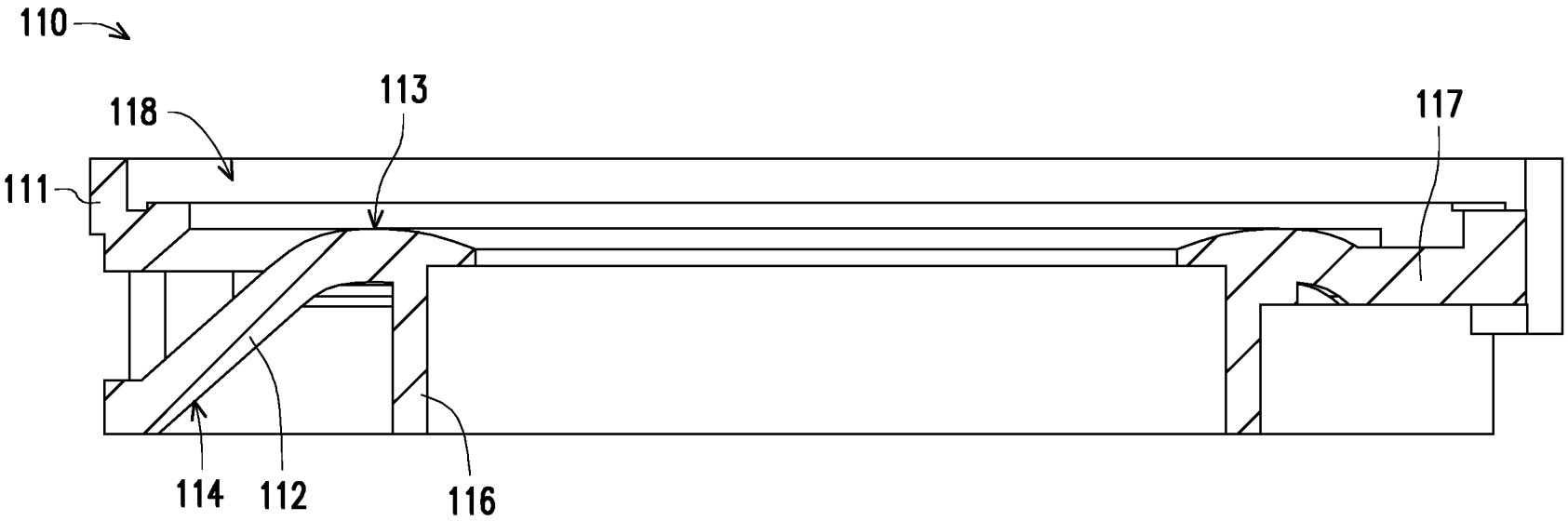
FIG. 9 is a schematic cross-sectional diagram of FIG. 6 along the line B-B.

FIG. 6 is a schematic top 3D diagram illustrating the frame of the speaker depicted in FIG. 1. FIG. 7 is a schematic bottom 3D diagram illustrating the frame of the speaker depicted in FIG. 1. FIG. 8 is a schematic 3D diagram separated from FIG. 6 along a line B-B. FIG. 9 is a schematic cross-sectional diagram of FIG. 6 along the line B-B.

Referring to FIG. 1 to FIG. 9, in the present embodiment, the frame 110 has a lateral wall 111, the bottom wall 112, an accommodation space S (illustrated in FIG. 5) defined by the lateral wall 111 and the bottom wall 112 and an opening end 118 located at a top end of the accommodation space S. The first tuning portion 120 is formed on the lateral wall 111 of the frame 110. In the present embodiment, the first tuning portion 120 is formed by at least one through hole surrounding the lateral wall 111, but the form of the first tuning portion 120 is not limited thereto. The number of the first tuning portion 120 is plural, and a shape of the first tuning portion 120 may be a polygonal shape (e.g., a rectangular shape), a circular shape or other shapes. Certainly, the type, shape and number of the first tuning portion 120 are not limited thereto.

Returning to FIG. 3, the vibration system 130 is disposed in the accommodation space S of the frame 110. The vibration system 130 includes a vibration film 132. The vibration film 132 is disposed at the opening end 118 of the frame 110. To be more specific, a suspension side edge 134 of the vibration film 132 is attached to a part of the frame 110 surrounding the opening end 118. The vibration film 132 vibrates along an axial direction of the frame 110. In this case, the axial direction of the frame 110 is presented by a first axis. The vibration film 132 moving along the axial direction (i.e., the first axis) of the frame 110 may facilitate the sound having preferable realism. A rear chamber C is defined by the vibration film 132 and the bottom wall 112 of the frame 110, and the rear chamber C communicates with the first tuning portion 120. It should be mentioned that the vibration system 130 actually further includes other elements, such as a voice coil (not shown), and in order to avoid too complicated lines in the figures, only the elements related to the invention are illustrated.

The magnetic circuit system 140 is disposed in the accommodation space S of the frame 110. The magnetic circuit system 140 may include a pole piece, a permanent magnet and so on, but the invention is not limited thereto. In the present embodiment, the frame 110 further includes an inner wall 116 which is located inside the lateral wall 111 and the bottom wall 112 and communicates with the lower surface 114 of the bottom wall 112. In the present embodiment, the magnetic circuit system 140 is disposed inside the inner wall 116, but the disposition position of the magnetic circuit system 140 is not limited thereto.

It is to be mentioned that in the present embodiment, the bottom wall 112 is recessed in a direction toward the vibration film 132 (i.e., in a direction toward the opening end 118). More clearly, in the present embodiment, the bottom wall 112 is connected to a side of the inner wall 116 which is adjacent to the vibration film 132 and a side of the lateral wall 111 which is far away from the vibration film 132, and in this way, the bottom wall 112 is inclined.

When the vibration film 132 vibrates along the first axis, the air in the rear chamber C is extruded by the vibration film 132 which moves reciprocally to form an airflow, and the airflow flows along the inclined bottom wall 112 to the first tuning portion 120 formed on the lateral wall 111 and is guided out of the speaker 100. Thus, in the present embodiment, a first tuning path P1 (illustrated in FIG. 3) is formed jointly by the rear chamber C and the first tuning portion 120. In the present embodiment, the first tuning portion 120 is used to guide the air from the rear chamber C, thereby achieving an effect of balancing internal and external air pressures. As such, characteristics of the sound output by the speaker 100, such as a sound curve, an audio frequency and sound quality, may meet design requirements.

In the present embodiment, the first tuning path P1 is not parallel to a vibration direction of the vibration film 132. More specifically, the airflow from the rear chamber C of the first tuning path P1 flows in a direction along the inclined bottom wall 112, and the airflow from the first tuning portion 120 of the first tuning path P1 flows along a second axial direction A2 and is guided out of the first tuning portion 120 formed on the lateral wall 111 of the frame 110. The second axial direction A2 in this case refers to an axial direction of the first tuning portion 120 (a through hole) on the lateral wall 111 and is considered as a horizontal direction according to the illustration of FIG. 3. The vibration direction of the vibration film 132 which also refers to the axial direction of the frame 110 or a first axial direction A1 is considered as a vertical direction according to the illustration of FIG. 3 and is not parallel to the first tuning path P1.

It is to be mentioned that in the speaker 100 of the present embodiment, the first tuning portion 120 is formed on the lateral wall 111 of the frame 110, such that when the vibration film 132 vibrates, the airflow generated in the rear chamber C flows along the first tuning portion 120 formed on the lateral wall 111 is guided out of the first tuning portion 120. In other words, the airflow is exhausted from the side of the speaker 100, rather than from the bottom of the speaker 100. Thus, the bottom wall 112 of the speaker 100 may be disposed closely to the head phone inner casing or other elements, while a distance between the bottom wall 112 of the speaker 100 and the elements located in the rear neither causes the resonance reflection nor influences the sound curve of the speaker 100, so as to achieve preferable sound performance. As such, the speaker 100 may be applied to an electronic device, such as a thin head phone.

Moreover, it may clearly show according to the illustration of FIG. 3 that in the present embodiment, a radial sectional shape of the rear chamber C is gradually expanded in a direction from the inside toward the lateral wall 111 (i.e., two sides in FIG. 3). Alternatively, the radial sectional shape of the rear chamber C is gradually expanded in a radiation direction. More specifically, in the present embodiment, a part of the bottom wall 112 which is adjacent to the inner wall 116 has a closer distance to the vibration film 132, and other parts of the bottom wall 112 which are farther away from the inner wall 116 have gradually increased distances to the vibration film 132. Such design may allow the airflow to flow along the first tuning path P1 more smoothly to be exhausted, thereby reducing acoustic resistance.

Moreover, in the present embodiment, a radial sectional shape of an upper surface 113 of the bottom wall 112 at least partially corresponds to the radial sectional shape of the vibration film 132. It specially refers to the part of the bottom wall 112 which is adjacent to the inner wall 116, and the radial sectional shape of the upper surface 113 of the part corresponds to the radial sectional shape of the vibration film 132. Such design may achieve preferable performance of the sound at a high-frequency band.

In the present embodiment, the vibration film 132 vibrates along the axial direction of the frame 110 to define the first axial direction A1 and to define the axial direction of the first tuning portion 120 (the through hole) on the lateral wall 111 as the second axial direction A2. The first axial direction A1 and the second axial direction A2 have an intersection angle therebetween. For example, the first axial direction A1 and the second axial direction A2 have a vertical angle (90 degrees) therebetween. Certainly, the angle between the first axial direction A1 and the second axial direction A2 is not limited thereto.

Returning to FIG. 2, in the present embodiment, since the bottom wall 112 is recessed toward the vibration film 132, a second tuning portion 150 is formed between the lower surface 114 of the bottom wall 112 of the frame 110 and the inner wall 116. The bottom wall 112 has a first through hole 115 to allow the rear chamber C and the second tuning portion 150 to communicate with each other.

Moreover, the speaker 100 may further selectively include a plate 170 attached to the lower surface 114 of the bottom wall 112 of the frame 110. The plate 170 may be a Mylar film or a head phone inner casing, but the type of the plate 170 is not limited thereto. It may be clear shown in a viewing angle along the axial direction that the second tuning portion 150 presents a C shape, the first through hole 115 of the bottom wall 112 is adjacent to an end of the C shape, the plate 170 has a second through hole 172 communicating with the second tuning portion 150, the second through hole 172 is adjacent to the other end of the C shape, and a second tuning path P2 is formed by the first through hole 115, the second tuning portion 150 and the second through hole 172. Certainly, relative positions of the first through hole 115 of the bottom wall 112 and the second through hole 172 of the plate 170 are not limited thereto.

In the present embodiment, the first tuning path P1 constituted by the rear chamber C and the first tuning portion 120 formed on the lateral wall 111 is capable of tuning sound in all bands (e.g., bands between frequencies 20 Hz and 20 KHz, which is not limited in this case). Moreover, the second tuning path P2 constituted by the first through hole 115, the second tuning portion 150 and the second through hole 172 is capable of tuning sound in low-frequency bands (e.g., bands between frequencies 20 Hz and 200 Hz, which is not limited in this case). Thus, the speaker 100 of the present embodiment may achieve a dual tuning effect with the aforementioned structure.

According to the illustration of FIG. 2, in the present embodiment, the second tuning portion 150 presenting the C shape has a notch 152, the frame 110 further includes a platform 117 connected to the inner wall 116 and the lateral wall 111 and located at the notch 152. The speaker 100 further includes a circuit board 160 disposed on the platform 117. Certainly, a shape of the second tuning portion 150 and a position where the circuit board 160 is disposed on the frame 110 are not limited thereto.

Moreover, according to the illustration of FIG. 3, the speaker 100 further include a tuning paper 180 disposed at the lateral wall 111 to shield the first tuning portion 120. A designer may select the tuning paper 180 with acoustic resistance at different levels according to desired tuning effects, and the type, shape, number of the 180 and a corresponding relationship with the the first tuning portion 120 are not limited herein.

Based on the above, in the invention, the first tuning portion is formed on the lateral wall of the frame, such that when the vibration film vibrates, the airflow generated in the rear chamber flows along the first tuning portion formed on the lateral wall and is guided out of the first tuning portion. In other words, the airflow is exhausted from the side of the speaker rather than from the bottom of the speaker. Thus, the speaker of the invention can be disposed closely to the head phone inner casing, and the head phone inner casing can be close to the bottom wall of the speaker of the invention in a short distance, without causing resonance reflection or influencing a sound curve of the speaker, so as to achieve preferable sound performance.

What is claimed is:

1. A speaker, comprising:

a frame, having a lateral wall, a bottom wall, an accommodation space defined by the lateral wall and the bottom wall and an opening end located at a top end of the accommodation space;

a first tuning portion, formed on the lateral wall of the frame;

a vibration system, disposed in the accommodation space of the frame and comprising a vibration film vibrating along an axial direction of the frame and a rear chamber being defined by the vibration film and the bottom wall of the frame; and a magnetic circuit system, disposed in the accommodation space of the frame, wherein when the vibration film vibrates, an airflow generated in the rear chamber flows along the first tuning portion formed on the lateral wall and is guided out of the first tuning portion, so as to form a first tuning path, wherein a radial sectional shape of the rear chamber is gradually expanded in a direction from the inside toward the lateral wall.

2. The speaker according to claim 1, wherein the bottom wall is recessed in a direction toward the vibration film, the frame comprises an inner wall connected to a lower surface of the bottom wall, and a second tuning portion is formed between the lower surface of the bottom wall of the frame and the inner wall.

3. The speaker according to claim 2, wherein the second tuning portion presents a C shape in a viewing angle along the axial direction and has a notch, the frame comprises a platform connected to the inner wall and the lateral wall and located at the notch, and the speaker comprises a circuit board disposed on the platform.

4. The speaker according to claim 2, wherein the bottom wall has a first through hole to allow the rear chamber and the second tuning portion to communicate with each other.

5. The speaker according to claim 2, further comprising a plate attached to the lower surface of the bottom wall of the frame.

6. The speaker according to claim 5, wherein the second tuning portion presents a C shape in a viewing angle along the axial direction, the bottom wall has a first through hole adjacent to an end of the C shape, the plate has a second through hole communicating with the second tuning portion, the second through hole is adjacent to the other end of the C shape, and a second tuning path is formed by the first through hole, the second tuning portion and the second through hole.

7. The speaker according to claim 5, wherein the plate is a Mylar film or a head phone inner casing.

8. The speaker according to claim 1, wherein a radial sectional shape of an upper surface of the bottom wall at least partially corresponds to a radial sectional shape of the vibration film.

9. The speaker according to claim 1, further comprising a tuning paper, disposed at the lateral wall to shield the first tuning portion.

10. The speaker according to claim 1, wherein the first tuning portion is formed by at least one through hole surrounding the lateral wall.

11. The speaker according to claim 1, wherein the first tuning path is not parallel to the vibration direction of the vibration film.

12. The speaker according to claim 1, wherein the vibration film vibrates along the axial direction of the frame to define a first axial direction, the airflow generated in the rear chamber flows along a second axial direction and is guided out of the first tuning portion formed on the lateral wall of the frame, and the first axial direction and the second axial direction have an intersection angle therebetween.

13. The speaker according to claim 12, wherein the first axial direction and the second axial direction have a vertical angle therebetween.

* * * * *